United States Patent [19]

Clark et al.

[11] Patent Number: 4,785,303

[45] Date of Patent: Nov. 15, 1988

[54] OMNIDIRECTIONAL DIPOLE LOOP ANTENNA ARRAY

[75] Inventors: Reginald E. J. Clark; Derek J. Clark, both of Kings Lynn, Great Britain

[73] Assignee: Maxview Aerials Limited, Kings Lynn, United Kingdom

[21] Appl. No.: 905,332

[22] PCT Filed: Dec. 12, 1985

[86] PCT No.: PCT/GB85/00579

§ 371 Date: Oct. 3, 1986

§ 102(e) Date: Oct. 3, 1986

[87] PCT Pub. No.: WO86/03624

PCT Pub. Date: Jun. 19, 1986

[30] Foreign Application Priority Data

Dec. 13, 1984 [GB] United Kingdom ..... 8431457

[51] Int. Cl.[4] ..... H01Q 7/00

[52] U.S. Cl. ..... 343/742; 343/743; 343/842; 343/866

[58] Field of Search ..... 343/741, 742, 743, 764, 343/842, 866, 867, 868

[56] References Cited

U.S. PATENT DOCUMENTS

| | | | |
|---|---|---|---|
| 1,994,237 | 3/1935 | Woods | 343/867 |
| 2,217,911 | 10/1940 | Lindenblad | 343/800 |
| 2,373,206 | 4/1945 | Thomas | 343/867 |
| 2,533,900 | 12/1950 | Shanklin | 343/799 |
| 2,747,183 | 5/1956 | Edwards | 343/893 |
| 2,787,788 | 4/1957 | Clough | 343/742 |
| 3,329,954 | 7/1967 | Travers | 343/842 |
| 4,479,127 | 10/1984 | Barbano | 343/742 |

FOREIGN PATENT DOCUMENTS

| | | | |
|---|---|---|---|
| 0084097 | 2/1957 | Netherlands | 343/742 |

*Primary Examiner*—William L. Sikes
*Assistant Examiner*—Doris J. Johnson
*Attorney, Agent, or Firm*—Berman, Aisenberg & Platt

[57] ABSTRACT

An omni-directional aerial, more especially for the reception of domestic television programs in the U.H.F. band, comprises four folded dipole elements (1–4), each formed as a self-supporting open-ended wire loop (1A, 1B, 1C, 1D) integral with twin feeder portions (1E, 1F; 2E, 2F; 3E, 3F; 4E, 4F). The loops are arranged in planes parallel to a common central axis and are regularly angularly displaced about this axis so that opposed pairs of loops lie in parallel planes. The twin feeder portions (1E, 1F; 2E,2F; 3E,3F; 4E,4F) are connected in common to respective terminal means at the central axis, and each pair of feeder portions of each loop extend parallel to one another in a plane radial to the central axis which enables simple matching of the impedance of the aerial to a connecting cable.

12 Claims, 3 Drawing Sheets

OMNIDIRECTIONAL DIPOLE LOOP ANTENNA ARRAY

Figure 1:
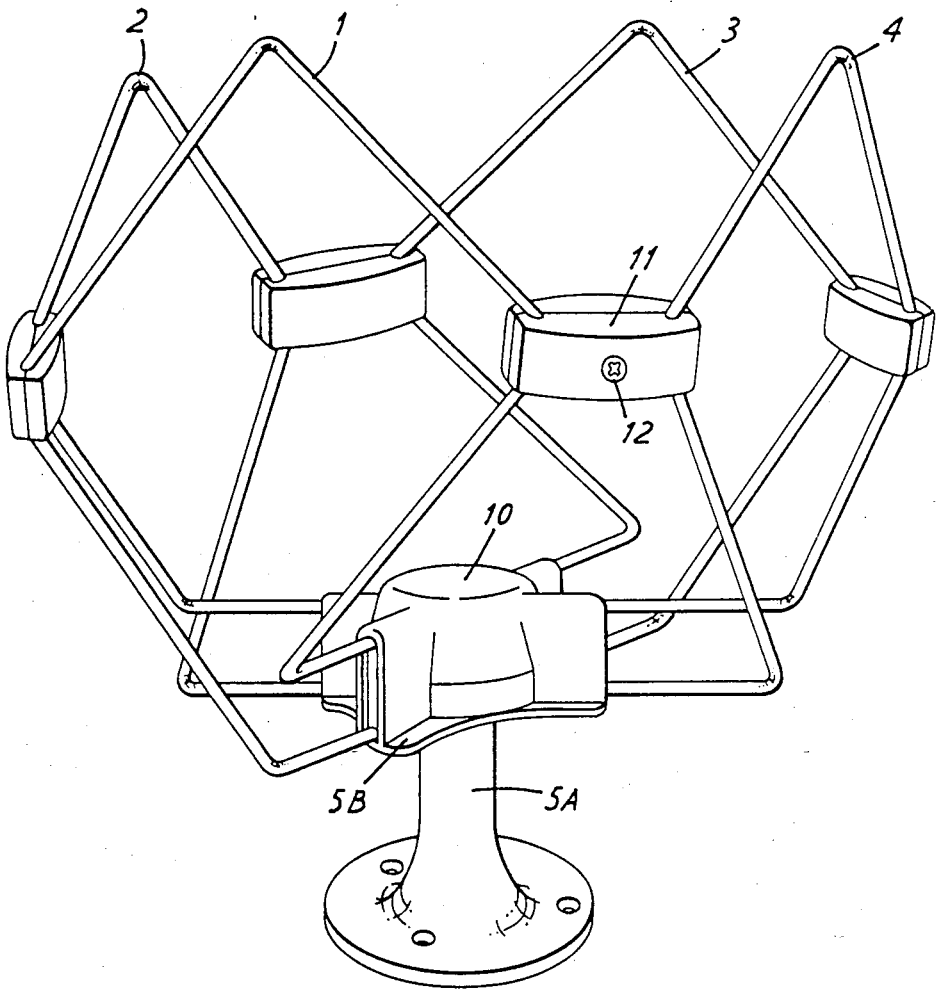

This invention concerns improvements in and relating to aerials, and more especially to aerials for radio and television reception in the VHF and UHF frequency band.

Conventional dipole aerials used for the reception of radio and television in the VHF and UHF frequency band have directional characteristics such that for optimum gain they must be aligned in a predetermined position relatively to the transmitter. Such aerials therefore have significant disadvantages when used on mobile vehicles, since, with the aerial in the fixed position on the vehicle, the strength of any signal received will vary in accordance with the direction in which the vehicle is moving and the corresponding alignment of the aerial relatively to the transmitter.

Attempts to produce omni-directional aerials for use on mobile vehicles have hitherto not proved entirely successful.

It is accordingly an object of the invention to provide a radio or television aerial of which the construction is such that acceptable signal reception can be obtained regardless of the relative alignment of the aerial and the transmitter, at least in the horizontal plane.

An aerial construction is known, (see U.S. Pat. No. 4,479,127) which comprises four substantially identical folded dipole elements each element defining a loop lying in a plane parallel to a common central axis which, in use, is intended to be vertical, the planes of all of said loops being equally spaced from said central axis and the planes of adjacent ones of said loops being relatively angularly displaced by 90° about said central axis such that said dipole elements are arranged in mutually facing pairs disposed on opposite sides of said central axis, all of said dipole elements being connected to common whereby the polar response of said aerial is substantially circular about said axis. Such an aerial, in the case of which a horizontally polarised omni-directional radiation pattern is obtained over a wide bandwidth when used as a transmitting aerial, is, however, of relatively complicated construction, special means being necessary to obtain the required impedance of the aerial over the appropriate bandwidth. This aerial does not therefore meet the need for an omni-directional receiving aerial of simple and robust construction suitable for use by the consumer for the purpose of reception of domestic radio or television programmes.

In accordance with the invention, however, this object is achieved by a construction as outlined above which is characterised in that each folded dipole element consists of a single open ended loop of which the ends are spaced apart in the respective plane in a direction parallel to the said central axis, and that the respective ends of each loop are coupled to common terminal means, by means of twin feeders extending from said ends of the loop parallel to one another and radially towards said central axis.

The size and shape of each dipole element may vary in accordance with the frequency of electromagnetic waves to be received, and in the case of a UHF television may comprise loop aerial elements of round or square configuration. Square elements are found to be more advantageous, particularly when opposite corners of the square are aligned on vertical and horizontal axes respectively, since the aerial can be used for the reception of both horizontally and vertically polarised transmissions.

In the case of an aerial for reception of VHF frequencies, which are usually horizontally polarised, the dipole elements are preferably in the form of folded dipole of which the horizontal dimension is greater than the vertical.

An aerial in accordance with the invention has surprisingly been found to give a response that is truly omni-directional, whilst also having a very wide bandwidth.

One embodiment of aerial in accordance with the invention is illustrated in the accompanying drawings, in which FIG. 1 is a perspective view of an aerial in accordance with the invention.

Figure 2:
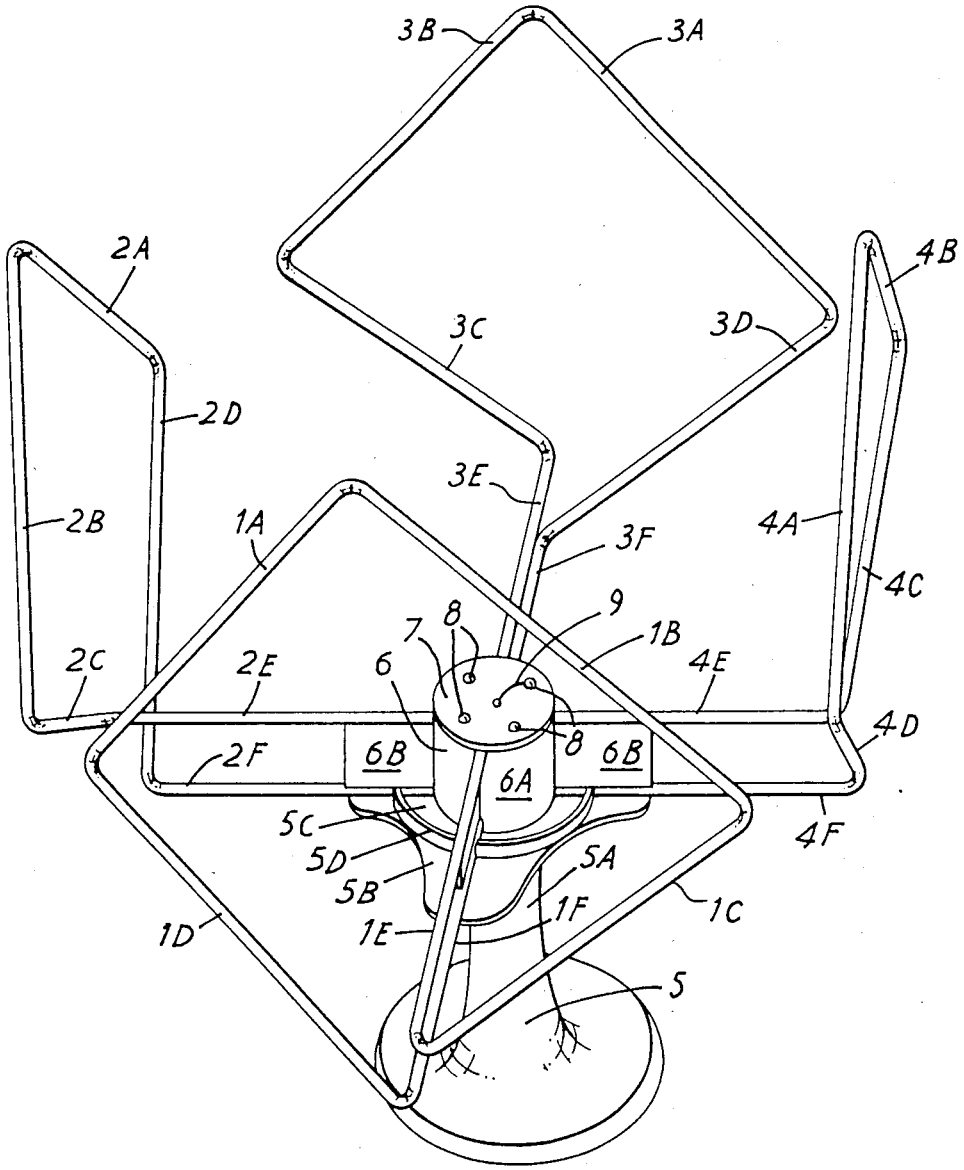
Figure 3:
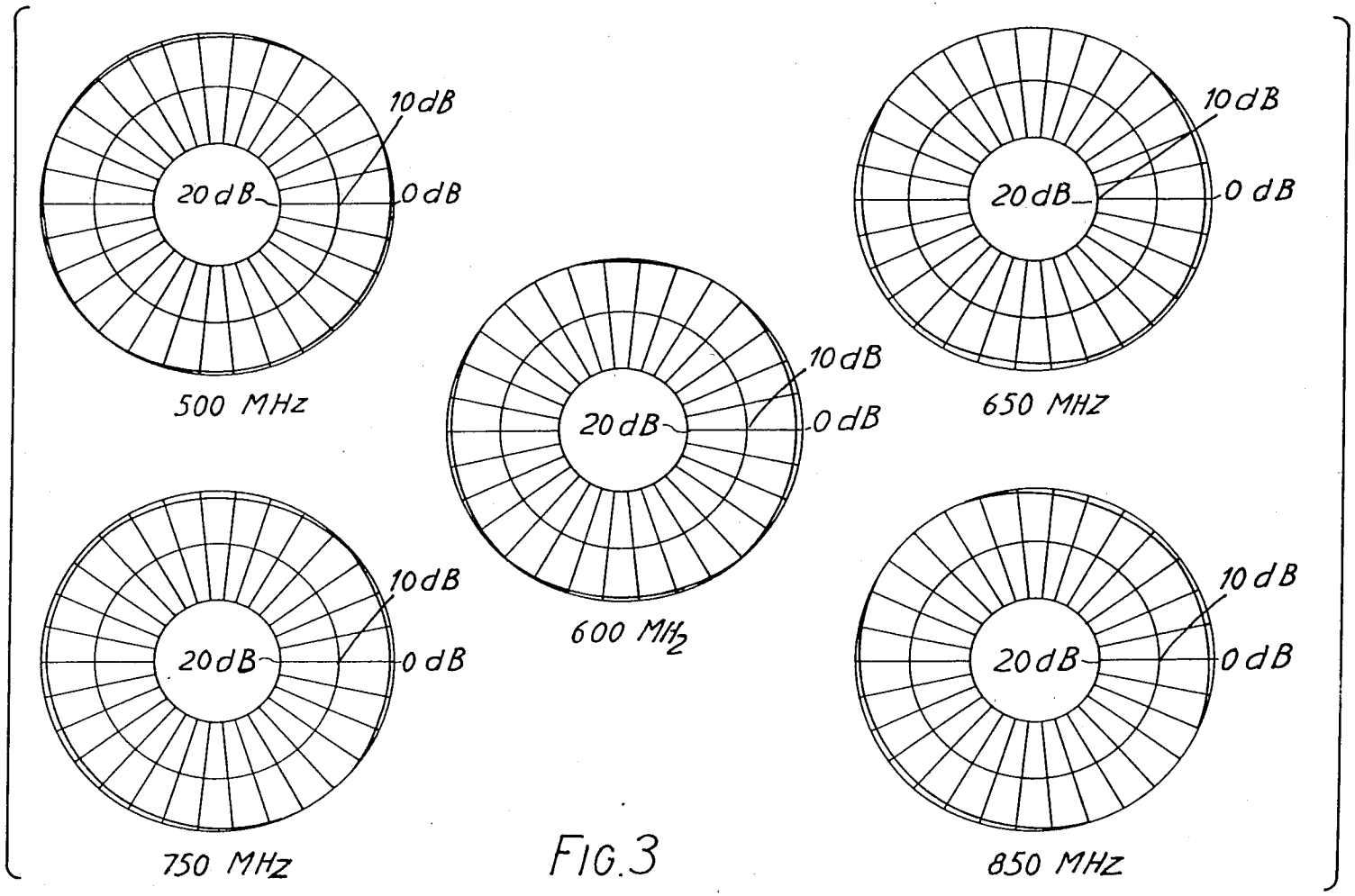

FIG. 2 is a view similar to FIG. 1 with components of the aerial assembly removed to show more clearly the configuration of individual aerial elements, and FIG. 3 is a polar diagram illustrating the response of the aerial illustrated in FIGS. 1 and 2.

Referring to FIGS. 1 and 2 of the drawings, there is shown an aerial in accordance with the invention which is intended for use in the reception of United Kingdom standard television programmes in the UHF band. It will be appreciated that such an aerial must be capable of receiving transmissions with the electrical field polarised in either the horizontal or the vertical plane. Its beam width in the vertical plane should be narrow so as to reduce ground, thermal and man made noise. It must present a reasonable 75 ohm impedance at all frequencies in the range so as to preserve teletext eye height, prevent picture ringing effects and/or not degrade the noise performance of any associated aerial amplifier. The aerial comprises four individual dipole aerial elements 1 to 4, each of which comprises four rectilinear sections illustrated in FIG. 2 at 1A, 1B, 1C and 1D in the case of the element 1, which sections are arranged in a common plane to form an approximately square loop aerial. The respective aerial elements are supported from a stand 5 by stem portions, illustrated at 1E and 1F in the case of the element 1, the stem portions extending at right angles to the plane of the square loop. Corresponding portions of the remaining aerial elements are indicated by like reference letters and will not be referred to individually, all such elements being identical in construction.

As illustrated, each square loop element is located in a vertical plane with diagonally opposite corners lying on a horizontal axis, the planes of the oppositely disposed elements being mutually parallel.

The stand 5 comprises a pedestal portion 5A terminating in a horizontal platform 5B containing a central recess 5C bounded by a shallow upright cylindrical wall 5D. The wall 5D contains four openings arranged crosswise to receive the lower stem portions 1F, 2F, 3F and 4F of the aerial elements. The upper stem portions 1E, 2E, 3E and 4E of the aerial elements are located in spaced relation to the lower stem portions by means of a spacer member 6 which comprises a central cyclindrical portion 6A and four integral webs 6B which extend crosswise to lie between the respective stem portions of each aerial element. The free ends of the stem portions 1E, 2E, 3E and 4E are received in grooves, not shown, in a top end wall of the central cylindrical portion 6A and are clamped in place by means of an electrically conductive end plate 7 secured to the member 6 by means of self-tapping screws 8. The end plate 7 serves to provide an electrical contact between the central conductor 9 of a co-axial aerial cable, the spacer 6 being of electrically insulating material so the upper and lower stems portions of the respective dipole elements are electrically isolated from one another. The lower stem portions 1F,2F,3F and 4F are likewise electrically connected together by means of a corresponding end plate, not shown, secured to the underside of the spacer 6 and coupled to the outer screening conductor of the aerial cable.

As shown in FIG. 1, the spacer member 6 and the aerial elements clamped thereto are secured in place on the stem 5A by means of a shroud member 10 of moulded electrically insulating synthetic plastics material which is arranged to make snap engagement with the platform 5B in a manner not shown.

The horizontal corners of the respective aerial elements are linked by means of insulator members 11 moulded in halves from electrically insulating synthetic plastics material, and assembled by means of self-tapping screws 12.

It will be seen from the above disclosure that the preferred embodiment of the invention provides a convenient and compact aerial assembly that is of elegant appearance. Moreover, the assembly illustrated has been found to have a surprisingly good 360° signal acceptance in the horizontal plane, the horizontal polar diagram being almost perfectly circular over a wide range of frequencies, as shown in FIG. 3.

It will be appreciated that various alterations and modifications may be made to the arrangement described, without departing from the scope of the invention. By way of example, however, in the specific embodiment illustrated, the square dipole elements 1 to 4 were formed of wire 4.8 mm in diameter and shaped to define a square loop of approximately 12 cm along each side, whilst allowing a distance between the centres of the perpendicular stem portions of approximately 3 cm. The latter form twin parallel feeders having a 300 ohm impedance over the bandwidth of the aerial and thus when the four feeders are connected in parallel the impedance of the aerial matches the 75 ohm impedance of the standard coaxial cable used for television aerial connection. The distance between the oppositely disposed dipole elements was approximately 19 cm corresponding to half the wavelength of the central frequency of the UHF band and the resulting assembly was found to have a usable bandwidth extending over the full UHF television frequency range of 470 to 860 MHz. Thus a convenient and compact UHF television aerial was provided suitable for use on any mobile vehicle such as coaches, cars, yachts, ships etc.

We claim:

1. An aerial comprising four substantially identical folded dipole elements each element defining a free-standing loop lying in a plane parallel to a common central axis which, in use, is intended to be vertical, the planes of all of said loops being equally spaced from said central axis and the planes of adjacent ones of said loops being relatively angularly displaced by 90° about said central axis such that said dipole elements are arranged in mutually facing pairs disposed on opposite sides of said central axis, all of said dipole elements being connected in common whereby the polar response of said aerial is substantially circular about said axis, characterized in that each folded dipole element consists of a single open ended loop of which the ends are spaced apart in the respective plane in a direction parallel to the said central axis, and that the respective ends of each loop are coupled to common terminal means by means of twin feeders extending from said ends of the loop parallel to one another and radially towards said central axis.

2. An aerial as claimed in claim 1 characterised in that the loops defined by said dipole elements are of quadrilateral configuration, with one diagonal of each quadrilateral lying approximately in a plane at right angles to said axis.

3. An aerial as claimed in claim 2 characterised in that it is a television receiving aerial and that the loops defined by said dipole elements are of generally square configuration.

4. An aerial as claimed in any one of claims 1–3, characterised in that the loop of each dipole element is formed integrally with said twin feeders as a self-supporting wire structure, and that each dipole element is supported by mounting means engaging said twin feeder portions.

5. An aerial as claimed in claim 4, characterised in that said dipole elements are further mechanically linked by electrically insulating means connecting the nearest portions of each adjacent pair of loops, whereby the loops are linked together to form a ring.

6. An aerial as claimed in claim 4, characterized in that said mounting means comprises a member of electrically insulating material, said member comprising a hub portion concentric with said central axis and four web portions extending radially outward from said hub, the twin feeders of each dipole element being received in corresponding radial grooves or recesses of said hub and vertically spaced apart by a corresponding one of said web portions.

7. An aerial as claimed in claim, 6, 10, 11 or 12 characterised in that said twin feeders are clamped in place in said grooves by electrically conductive plates secured to axial ends of said hub portion and forming said terminal means.

8. An aerial as claimed in claim 7, characterised in that said hub portion is located upon a stand having a central stem for receiving a coaxial cable to be connected to said terminal means.

9. An aerial as claimed in claim 8, characterized in that said hub portion is secured upon said stand by means of a shroud of electrically insulating material which is shaped to enclose said hub portion, said webs and the corresponding portions of said feeders and is secured to a supporting platform of said stand.

10. An aerial as claimed in claim 5, characterized in that said mounting means comprises a member of electrically insulating material, said material comprising a hub portion concentric with said central axis and four web portions extending radially outward from said hub, the twin feeders of each dipole element being received in corresponding radial grooves or recesses of said hub and vertically spaced apart by a corresponding one of said web portions.

11. An aerial as claimed in claim 4, characterized in that said mounting means comprises a member of electrically insulating material, said member comprising a hub portion concentric with said central axis and four web portions extending radially outward from said hub, the twin feeders of each dipole element being received in corresponding radial grooves or recesses of said hub and spaced apart by a corresponding one of said web portions.

12. An aerial as claimed in claim 5, characrerized in that said mounting means comprises a member of electrically insulating material, said member comprising a hub portion concentric with said central axis and four web portions extending radially outward from said hub, the twin feeders of each dipole element being received in corresponding radial grooves or recesses of said hub and vertically spaced apart by a corresponding one of said web portions.

* * * * *